US011187103B2

(12) United States Patent
Nagai et al.

(10) Patent No.: US 11,187,103 B2
(45) Date of Patent: Nov. 30, 2021

(54) SYSTEM CONFIGURATION AND OPERATION METHOD FOR IMPROVING STEAM TURBINE POWER GENERATION EFFICIENCY

(71) Applicant: Mitsubishi Power, Ltd., Yokohama (JP)

(72) Inventors: Yurika Nagai, Yokohama (JP); Akimitsu Seo, Yokohama (JP); Kazuya Sakakibara, Yokohama (JP)

(73) Assignee: Mitsubishi Power, Ltd., Yokohama (JP)

( * ) Notice: Subject to any disclaimer, the term of this patent is extended or adjusted under 35 U.S.C. 154(b) by 92 days.

(21) Appl. No.: 16/702,124

(22) Filed: Dec. 3, 2019

(65) Prior Publication Data

US 2020/0248584 A1 Aug. 6, 2020

(30) Foreign Application Priority Data

Feb. 5, 2019 (JP) ..... JP2019-018598

(51) Int. Cl.
*F01D 25/10* (2006.01)
*F01D 13/00* (2006.01)

(52) U.S. Cl.
CPC ..... *F01D 25/10* (2013.01); *F01D 13/00* (2013.01); *F05D 2220/31* (2013.01)

(58) Field of Classification Search
None
See application file for complete search history.

(56) References Cited

U.S. PATENT DOCUMENTS 4,651,532 A * 3/1987 Abe ..... F01K 7/24 60/646
5,498,131 A * 3/1996 Minto ..... F01D 5/08 415/115

(Continued)

FOREIGN PATENT DOCUMENTS

EP 2937523 A1 * 10/2015 ..... F01D 25/32
JP JR 2006-17016 A 1/2006

(Continued)

OTHER PUBLICATIONS

Hindi language Office Action issued in Indian Application No. 20191409510 dated Jan. 15, 2021 with English translation (five (5) pages).

(Continued)

*Primary Examiner* — Michael Lebentritt
*Assistant Examiner* — Jason G Davis
(74) *Attorney, Agent, or Firm* — Crowell & Moring LLP

(57) ABSTRACT

A steam turbine power generation facility and an operation method of such facility not only overcome the thermal elongation difference between a revolving body and a stationary body of a turbine so as to shorten start-up time but also suppress the efficiency of such facility from deterioration. The steam turbine power generation facility includes a boiler to generate steam; a high-pressure turbine into which the steam generated by the boiler flows; an intermediate-pressure turbine into which steam worked at the high-pressure turbine flows; and a low-pressure turbine into which steam worked at the intermediate-pressure turbine flows, in which the high-pressure turbine and the intermediate-pressure turbine are respectively provided with a heating section which is formed by communicating through the high-pressure turbine and the intermediate-pressure turbine, (Continued)

and further includes a pipe to make the steam worked at the high-pressure turbine flow into the heating section.

10 Claims, 3 Drawing Sheets

(56) References Cited

U.S. PATENT DOCUMENTS

| | | | | |
|---|---|---|---|---|
| 9,581,049 | B2 * | 2/2017 | Helbig | F01D 19/02 |
| 2008/0019821 | A1 | 1/2008 | Narita et al. | |
| 2010/0031667 | A1 | 2/2010 | Hoffmann et al. | |

FOREIGN PATENT DOCUMENTS

| | | | |
|---|---|---|---|
| JP | 2008-25429 | A | 2/2008 |
| JP | 2010-518321 | A | 5/2010 |
| JP | 5388803 | B2 | 1/2014 |

OTHER PUBLICATIONS

Korean-language Office Action issued in Korean Application No. 10-2019-0163371 dated Nov. 25, 2020 with English translation (seven (7) pages).

* cited by examiner

SYSTEM CONFIGURATION AND OPERATION METHOD FOR IMPROVING STEAM TURBINE POWER GENERATION EFFICIENCY

CLAIM OF PRIORITY

The present application claims priority from Japanese Patent application serial no. 2019-18598, filed on Feb. 5, 2019, the content of which is hereby incorporated by reference into this application.

TECHNICAL FIELD

The present invention relates to a steam turbine power generation facility and an operation method of the steam turbine power generation facility.

BACKGROUND OF THE INVENTION

It is necessary to start up the steam turbine generation facility while suppressing the shaft vibration caused by the thermal elongation difference between the revolving body (or rotor) and the stationary body (or casing), so that it is necessary to overcome such thermal elongation difference between the revolving body and the stationary body as early as possible to shorten the start-up time.

The disclosure of Japanese Unexamined Patent Application Publication No. 2008-25429 is exemplified as the background art of the present technical field, in which the steam turbine includes a rotor to which movable vanes are attached; a diaphragm enclosing the outer periphery of the rotor; a casing which incorporates the diaphragm and the rotor and whose upper and lower half sections are integrally clamped with each other at the flange section; a displacement detector which measures the thermal elongation difference in the axial direction between the casing and the rotor; a heating/cooling apparatus which is attached to the flange section and heats/cools the flange section; and a control unit which heats/cools the flange section with the heating/cooling apparatus until the measured value of the displacement detector corresponds to the set value during non-regular operation (refer to the description of abstract).

SUMMARY OF THE INVENTION

In Japanese Unexamined Patent Application Publication No. 2008-25429, such a steam turbine is disclosed as overcoming the thermal elongation difference between the revolving body and the stationary body by heating/cooling the flange section in order to shorten the start-up time. However, in Japanese Unexamined Patent Application Publication No. 2008-25429, there is no disclosure on the supply source of the medium (steam) to heat/cool the flange section (casing flange). In order for the heating/cooling medium (steam) to be fed from the supply source to the flange section (casing flange), the enhancement of energy is necessary. When heating/cooling the flange section (casing flange), due to such enhanced energy, t the efficiency of the steam turbine power generation facility in which the steam turbine is installed may be deteriorated.

Thus, the present invention is to provide a steam turbine power generation facility and an operation method of the steam turbine power generation facility which not only overcome the thermal elongation difference between the revolving body and the stationary body of the steam turbine as early as possible so as to shorten the start-up time but also suppress the efficiency of such facility from deterioration.

In order to solve the above issue, the steam turbine power generation facility according to the present invention is characterized in including: a boiler to generate steam; a high-pressure turbine into which the steam generated by the boiler flows; an intermediate-pressure turbine into which the steam worked at the high-pressure turbine flows; and a low-pressure turbine into which the steam worked at the intermediate-pressure turbine flows, in which the high-pressure turbine and the intermediate-pressure turbine are respectively provided with a heating section (described below) which is formed by communicating through the high-pressure and intermediate-pressure turbines; the steam turbine power generation facility further including a pipe to make the steam worked at the high-pressure turbine flow into the heating section.

Further, the operation method of the steam turbine power generation facility according to the present invention is characterized in manipulating the opening/closing of: first valves which are disposed on a pipe to make the steam worked at the high-pressure turbine flow into the intermediate-pressure turbine; second valves which are disposed on a pipe which is branched from the pipe to make the steam worked at the high-pressure turbine flow into the intermediate-pressure turbine and makes the steam worked at the high-pressure turbine flow into a heating section; third valves which are disposed on a pipe to make the steam worked at the intermediate-pressure turbine flow into the low-pressure turbine; and fourth valves which are disposed on a pipe which is branched from the pipe to make the steam worked at the intermediate-pressure turbine flow into the low-pressure turbine and makes the steam worked at the intermediate-pressure turbine flow into the heating section, in which the first valves, the third valves, and the fourth valves are in closed condition while the second valves are in opened condition under an operation over a first load range.

According to the present invention, it is possible to provide a steam turbine power generation facility and an operation method of the steam turbine power generation facility not only overcoming the thermal elongation difference between the revolving body and the stationary body of the steam turbine so as to shorten the start-up time but also suppress the deterioration of the efficiency of such facility.

It should be noted that the issues, arrangements and effects other than depicted above are clarified according to the explanation of the following embodiments.

DETAILED DESCRIPTION

Hereinafter, the embodiments according to the present invention are explained with reference to the accompanying drawings. To note, the same or similar features are denoted with the same reference signs, in which upon certain explanations being overlapped, there are some cases where such explanations are omitted.

First Embodiment

Figure 1:
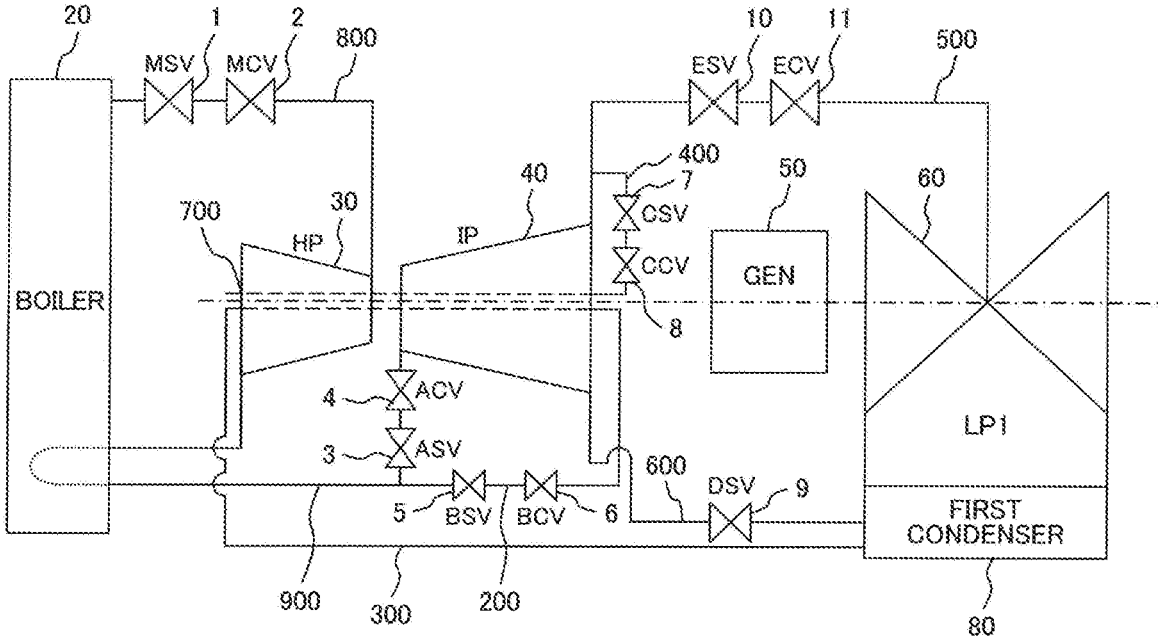
FIG. 1 is a schematic view illustrating the structure of the steam turbine power generation facility according to a first embodiment.

FIG. 1 is a schematic view illustrating the structure of the steam turbine power generation facility according to a first embodiment.

The steam turbine power generation facility according to the present embodiment includes: a boiler 20 to generate steam; a high-pressure turbine (HP) 30 into which the steam generated by the boiler 20 flows; an intermediate-pressure turbine (IP) 40 into which the steam (reheated steam) worked at the high-pressure turbine 30 flows; a first low-pressure turbine (LP1) 60 into which the steam worked at the intermediate-pressure turbine 40 flows; a generator (GEN) 50 which is driven by the high-pressure turbine 30, the intermediate-pressure turbine 40 and/or the first low-pressure turbine 60; and a first condenser 80 to condense the steam worked at the first low-pressure turbine 60 into water.

To note, according to the present embodiment, the high-pressure turbine 30, the intermediate-pressure turbine 40, the generator 50, and the first low-pressure turbine 60 are connected to one another in this order, but they may be connected to one another in the order of the high-pressure turbine 30, the intermediate-pressure turbine 40, the first low-pressure turbine 60, and the generator 50.

It should be noted that the high-pressure turbine 30, the intermediate-pressure turbine 40, and the first low-pressure turbine 60 are all steam turbines.

Then, a casing flange heating section (a steam pipe for heating the casing flange heating portion, hereinafter, just referred to as 'heating section' in some cases) 700 is formed in the vicinity of the rotary shaft (casing flange) of the high-pressure turbine 30 and the intermediate-pressure turbine 40. These heating sections 700 are formed by communicating through the high-pressure turbine 30 and the intermediate-pressure turbine 40. Steam flows into such heating section 700, thereby, overcoming the thermal elongation difference between the revolving body (or rotor) and the stationary body (or casing) of the high-pressure turbine 30 and the thermal elongation difference between the revolving body (or rotor) and the stationary body (or casing) of the intermediate-pressure turbine 40, which leads to successfully shortening the start-up time of the steam turbine power generation facility.

Further, the steam turbine power generation facility according to the present embodiment is provided with a pipe 800 (main steam in-flow pipe) to make the steam generated by the boiler 20 flow into the frontal stage side of the high-pressure turbine 30; a pipe 900 (intermediate-pressure turbine steam in-flow pipe) to make the steam (reheated steam) worked at the high-pressure turbine 30 flow into the frontal stage side of the intermediate-pressure turbine 40; and a pipe 500 (low-pressure turbine steam in-flow pipe) to make the steam worked at the intermediate-pressure turbine 40 flow into the frontal stage side of the first low-pressure turbine 60 (which is flowed out from the rear stage side of the intermediate-pressure turbine 40).

To note, according to the present embodiment, the steam worked at the high-pressure turbine 30 is reheated by the boiler 20 and the reheated steam is flowed into the intermediate-pressure turbine 40. In other words, the pipe 900 interconnects the high-pressure turbine 30, the boiler 20, and the intermediate-pressure turbine 40.

Further, the steam turbine power generation facility according to the present embodiment is provided with a pipe 200 (in-flow pipe of the steam for heating the casing flange heating portion) which is branched from the pipe 900 and makes the steam (reheated steam) worked at the high-pressure turbine 30 flow into the heating section (casing flange) 700; a pipe 300 (a condensing pipe of the steam for heating the casing flange heating portion) to make the steam worked at the heating section 700 flow into the first condenser 80; and a pipe 400 (in-flow pipe of the steam for heating the second casing flange heating portion) which is branched from the pipe 500 and makes the steam worked at the intermediate-pressure turbine 40 flow into the heating section (casing flange) 700.

In short, according to the present embodiment, such facility is provided with the pipe 200 to make the steam worked at the high-pressure turbine 30 flow into the heating section (casing flange) 700, in which the pipe 200 is a pipe is branched from the pipe 900 to make the steam worked at the high-pressure turbine 30 flow into the intermediate-pressure turbine 40.

Further, according to the present embodiment, such facility is provided with the pipe 400 to make the steam worked at the intermediate-pressure turbine 40 flow into the heating section (casing flange) 700, in which the pipe 400 is a pipe is branched from the pipe 500 to make the steam worked at the intermediate-pressure turbine 40 flow into the first low-pressure turbine 60.

In addition, in order to suppress the temperature of the intermediate-pressure turbine 40 from rising, such facility is provided with a pipe 600 (steam in-flow pipe to the first condenser) to make the steam worked at the intermediate-pressure turbine 40 flow into the first condenser 80 from the rear stage side of the intermediate-pressure turbine 40 by detouring the first low-pressure turbine 60.

The steam flowing through the pipe 200 (in-flow pipe of the steam for heating the casing flange heating portion) is steam (for heating the casing flange heating portion) intended for heating the heating section 700 (for heating the casing flange); and flows in from the heating section 700 on the rear stage side of the intermediate-pressure turbine 40 and flows out from the heating section 700 on the frontal stage side of the high-pressure turbine 30.

In short, the pipe 200 to make the steam worked at the high-pressure turbine 30 flow into the heating section (casing flange) 700 is connected to the heating section (casing flange) 700 on the rear stage side of the intermediate-pressure turbine 40.

Likewise, the steam flowing through the pipe 400 (in-flow pipe of the steam for heating the second casing flange heating portion) is steam (for heating the casing flange heating portion) intended for heating the heating section 700 (for heating the casing flange); and flows in from the heating section 700 on the rear stage side of the intermediate-pressure turbine 40 and flows out from the heating section 700 on the frontal stage side of the high-pressure turbine 30.

In short, the pipe 400 to make the steam worked at the intermediate-pressure turbine 40 flow into the heating section (casing flange) 700 is connected to the heating section (casing flange) 700 on the rear stage side of the intermediate-pressure turbine 40.

In this way, the provision of the pipe 200 and the pipe 400 according to the present embodiment, in other words, the steam flowing through the pipe 200 and the pipe 400 respectively overcomes the thermal elongation difference between the revolving body and the stationary body of the high-pressure turbine 30 and the thermal elongation difference between such bodies of the intermediate-pressure turbine 40 so as to successfully shorten the start-up time of the steam turbine power generation facility. Then, by utilizing the steam generated by the steam turbine power generation facility or by doing without any other supply source to feed (generate) the steam to overcome such thermal elongation difference in terms of the steam turbine power generation facility, it is unnecessary to enhance energy with which to feed such steam, thus successfully suppressing the efficiency of such facility from deterioration.

Moreover, the steam turbine power generation facility according to the present embodiment is provided: on the pipe 800, with valves M (main steam stop valve (MSV) 1 and main steam amount control valve (MCV) 2) to adjust the amount of the steam flowing into the high-pressure turbine 30; with valves A (first valves or intermediate-pressure turbine in-flow steam stop valve (ASV) 3 and intermediate-pressure turbine in-flow steam amount control valve (ACV) 4, which are disposed on a pipe directed to the intermediate-pressure turbine 40 after the branching of the pipe 900) to adjust the amount of the steam flowing into the intermediate-pressure turbine 40 after the branching of the pipe 900; and with valves E (third valves or low-pressure turbine in-flow steam stop valve (ESV) 10 and low-pressure turbine in-flow steam amount control valve (ECV) 11, which are disposed on a pipe directed to the first low-pressure turbine 60 after the branching of the pipe 500) to adjust the amount of the steam flowing into the first low-pressure turbine 60 after the branching of the pipe 500.

In addition, the steam turbine power generation facility according to the present embodiment is provided: on the pipe 200, with valves B (second valves or first casing flange in-flow steam stop valve (BSV) 5 and first casing flange in-flow steam amount control valve (BCV) 6, which are disposed on the pipe 200 branched from the pipe 900 and directed to the heating section 700) to adjust the amount of the steam (steam for heating the casing flange heating portion) flowing into the heating section 700; on the pipe 400, with valves C (fourth valves or second casing flange in-flow steam stop valve (CSV) 7 and second casing flange in-flow steam amount control valve (CCV) 8, which are disposed on the pipe 400 branched from the pipe 500 and directed to the heating section 700) to adjust the amount of the steam (steam for heating the casing flange heating portion) flowing into the heating section 700; and on the pipe 600, with a valve D (intermediate-pressure out-flow steam (vacuum) stop valve (DSV) 9) to switch on/off the steam flowing into the first condenser 80.

In short, the first valves (valves A) are disposed on the pipe 900 (after branched) to make the steam worked at the high-pressure turbine 30 flow into the intermediate-pressure turbine 40; the second valves (valves B) are disposed on the pipe 200 which is branched from the pipe 900 to make the steam worked at the high-pressure turbine 30 flow into the intermediate-pressure turbine 40 and makes the steam worked at the high-pressure turbine 30 flow into the heating section 700; the third valves (valves E) are disposed on the pipe 500 (after branched) to make the steam worked at the intermediate-pressure turbine 40 flow into the first low-pressure turbine 60; and the fourth valves (valves C) are disposed on the pipe 400 which is branched from the pipe 500 to make the steam worked at the intermediate-pressure turbine 40 flow into the first low-pressure turbine 60 and makes the steam worked at the intermediate-pressure turbine 40 flow into the heating section 700.

The operation method of the steam turbine power generation facility according to the present embodiment is as follows, in which the method of manipulating the opening/closing of the valves respectively is disclosed.

Under the operation over the low load range (the first range), it is prescribed that the valves A, the valves C, and the valves E are in closed condition whereas the valves B, the valve D, and the valves M are in opened condition.

Steam flows into the high-pressure turbine 30 from the boiler 20 (in which the valves M are opened), and the generator 50 is driven with the driving of the high-pressure turbine 30.

The steam worked at the high-pressure turbine 30 is reheated by the boiler 20, and the reheated steam flows through the pipe 200 so as to flow into the heating section 700) (in which the valves A are closed whereas the valves B are opened).

Then, the steam flowing into the heating section is utilized for heating the casing flange heating portion of the heating section 700 at the casing flange of the high-pressure turbine 30 and the intermediate-pressure turbine 40 respectively. Thereafter, the steam, which has been utilized for heating the casing flanges and whose temperature has lowered, flows through the pipe 300 so as to flow into the first condenser 80 and be condensed into water.

Under the operation over the low to middle load range (the second range higher in load than the first range), it is prescribed that the valves M are in opened condition; the valves A and the valves C transit from the closed condition to the opened condition; the valves B and the valve D transit from the opened condition to the closed condition; and the valves E are in closed condition.

Steam flows into the high-pressure turbine 30 from the boiler 20 (in which the valves M are opened), and the steam worked at the high-pressure turbine 30 is reheated by the boiler 20 so as to flow through the pipe 900 (in which the valves A are opened while the valves B are closed) and flow into the intermediate-pressure turbine 40, thereby, the high-pressure turbine 30 and the intermediate-pressure turbine 40 being driven, which leads to driving the generator 50.

The steam worked at the intermediate-pressure turbine 40 flows through the pipe 400 (in which the valves C are opened while the valves E are closed) so as to flow into the heating section 700.

Then, this steam is utilized for heating the casing flange heating portions of the heating sections 700 at the casing flanges of the high-pressure turbine 30 and the intermediate-pressure turbine 40. Thereafter, the steam, which has been utilized for heating the casing flanges and whose temperature has lowered, flows through the pipe 300 so as to flow into the first condenser 80 and be condensed into water.

Under the operation over the middle load range (the third range higher in load than the second range), it is prescribed that the valves A and the valves M are in opened condition; the valves C transit from the opened condition to the closed condition; the valves E transit from the closed condition to the opened condition; and the valves B and the valve D are in closed condition.

Steam flows into the high-pressure turbine 30 from the boiler 20 (in which the valves M are opened); the steam worked at the high-pressure turbine 30 is reheated by the boiler 20; the reheated steam flows through the pipe 900 (in which the valves A are opened while the valves B are closed) so as to flow into the intermediate-pressure turbine 40; the steam worked at the intermediate-pressure turbine 40 flows through the pipe 500 (in which the valves C are closed while the valves E are opened) so as to flow into the first low-pressure turbine 60, thereby, the high-pressure turbine 30, the intermediate-pressure turbine 40, and the first low-pressure turbine 60 are driven, which leads to driving the generator 50; and the steam worked at the first low-pressure turbine 60 flows into the first condenser 80 so as to be condensed into water.

To note, under the operation over the middle load range above, the steam for heating the casing flange heating portion does not flow to the heating section 700 of the casing flange at the high-pressure turbine 30 and the intermediate-pressure turbine 40 respectively.

As described above, according to the present embodiment, it is possible to provide a steam turbine power generation facility and an operation method of the steam turbine power generation facility not only overcoming the thermal elongation difference (at the heating section 700) between the revolving body and the stationary body of the turbine so as to shorten the start-up time of such facility but also suppress the efficiency of such facility from deterioration.

Second Embodiment

Figure 2:
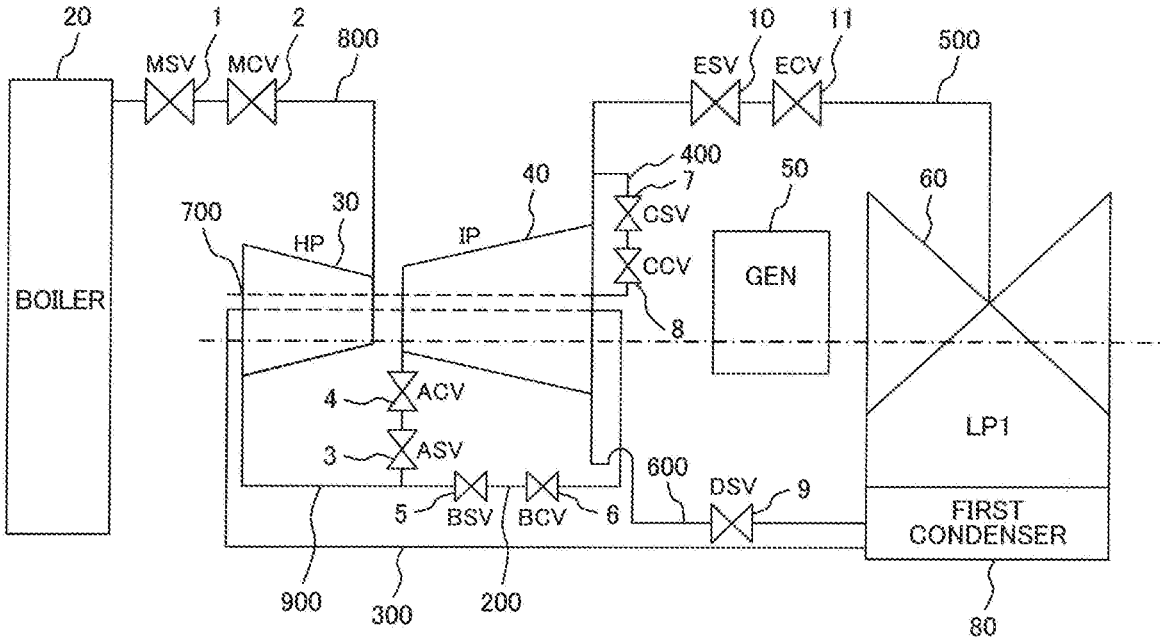
FIG. 2 is a schematic view illustrating the structure of the steam turbine power generation facility according to a second embodiment.

FIG. 2 is a schematic view illustrating the structure of the steam turbine power generation facility according to a second embodiment.

The steam turbine power generation facility according to the present embodiment includes: a boiler 20 to generate steam; a high-pressure turbine (HP) 30 into which the steam generated by the boiler 20 flows; an intermediate-pressure turbine (IP) 40 into which the steam worked at the high-pressure turbine 30 flows; a first low-pressure turbine (LP1) 60 into which the steam worked at the intermediate-pressure turbine 40 flows; a generator (GEN) 50 which is driven by the high-pressure turbine 30, the intermediate-pressure turbine 40 and/or the first low-pressure turbine 60; and a first condenser 80 to condense the steam worked at the first low-pressure turbine 60 into water.

The present embodiment differs from the first embodiment in that the steam worked at the high-pressure turbine 30 is not reheated by the boiler 20 but directly flowed into the intermediate-pressure turbine 40. In short, the pipe 900 interconnects the high-pressure turbine 30 and the intermediate-pressure turbine 40.

It should be noted that the other pipes are the same as those of the first embodiment and the places where the valves are disposed are the same as those of the first embodiment.

In addition, the operation method of the steam turbine power generation facility according to the present embodiment is the same as that according to the first embodiment.

In this way, the steam turbine power generation facility and operation method of such facility according to the present embodiment bring the same advantageous effects as those brought by the counterparts according to the first embodiment.

Third Embodiment

Figure 3:
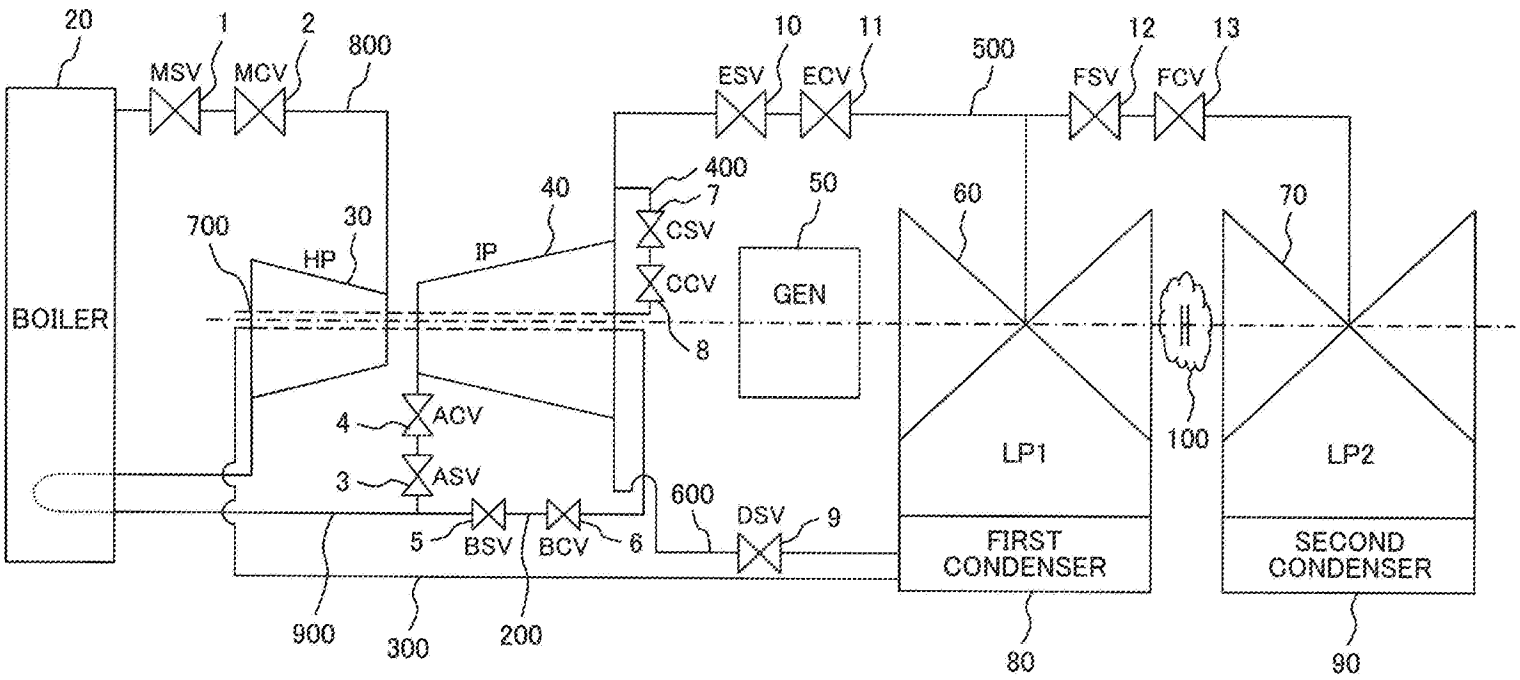
FIG. 3 is a schematic view illustrating the structure of the steam turbine power generation facility according to a third embodiment.

FIG. 3 is a schematic view illustrating the structure of the steam turbine power generation facility according to a third embodiment.

The steam turbine power generation facility according to the present embodiment includes: a boiler 20 to generate steam; a high-pressure turbine (HP) 30 into which the steam generated by the boiler 20 flows; an intermediate-pressure turbine (IP) 40 into which the steam (reheated steam) worked at the high-pressure turbine 30 flows; a first low-pressure turbine (LP1) 60 into which the steam worked at the intermediate-pressure turbine 40 flows; a second low-pressure turbine (LP2) 70 into which the steam worked at the intermediate-pressure turbine 40 flows; a generator (GEN) 50 which is driven by the high-pressure turbine 30, the intermediate-pressure turbine 40, the first low-pressure turbine 60, and/or the second low-pressure turbine (LP2) 70; a first condenser 80 to condense the steam worked at the first low-pressure turbine 60 into water; and a second condenser 90 to condense the steam worked at the second low-pressure turbine 70 into water.

Further, a clutch 100 is disposed between the first low-pressure turbine 60 and the second low-pressure turbine 70. The coupling condition between the first low-pressure turbine 60 and the second low-pressure turbine 70 is switched on and off with such clutch 100.

To note, according to the present embodiment, the high-pressure turbine 30, the intermediate-pressure turbine 40, the generator 50, the first low-pressure turbine 60, and the second low-pressure turbine 70 are connected to one another in this order.

It should be noted that the high-pressure turbine 30, the intermediate-pressure turbine 40, the first low-pressure turbine 60, and the second low-pressure turbine 70 are all steam turbines.

Then, a casing flange heating section (a steam pipe for heating the casing flange heating portion, hereinafter, just referred to as 'heating section' in some cases) 700 is formed in the vicinity of the rotary shaft (casing flange) of the high-pressure turbine 30 and the intermediate-pressure turbine 40. These heating sections 700 are formed by communicating through the high-pressure turbine 30 and the intermediate-pressure turbine 40. Steam flows into the heating sections 700, thereby, leading to overcoming the thermal elongation difference between the revolving body (rotor) and the stationary body (casing) of the high-pressure turbine 30 and the thermal elongation difference between the revolving body (rotor) and the stationary body (casing) of the intermediate-pressure turbine 40. This permits the start-up time of the steam turbine power generation facility to be shortened.

Further, the steam turbine power generation facility according to the present embodiment is provided with a pipe 800 (main steam in-flow pipe) to make the steam generated by the boiler 20 flow into the frontal stage side of the high-pressure turbine 30; a pipe 900 (intermediate-pressure turbine steam in-flow pipe) to make the steam (reheated steam) worked at the high-pressure turbine 30 flow into the frontal stage side of the intermediate-pressure turbine 40 (which steam is flowed out from the rear stage side of the high-pressure turbine 30); and a pipe 500 (low-pressure turbine steam in-flow pipe) to make the steam worked at the intermediate-pressure turbine 40 flow into the frontal stage side of the first low-pressure turbine 60 and/or the frontal stage side of the second low-pressure turbine 70 (which is flowed out from the rear stage side of the intermediate-pressure turbine 40).

To note, according to the present embodiment, the steam worked at the high-pressure turbine 30 is reheated by the boiler 20, and such reheated steam is flowed into the intermediate-pressure turbine 40. In short, the pipe 900 interconnects the high-pressure turbine 30, the boiler 20, and the intermediate-pressure turbine 40.

In addition, the steam turbine power generation facility according to the present embodiment is provided with a pipe 200 (in-flow pipe of the steam for heating the casing flange heating portion) which is branched from the pipe 900 and makes the steam (reheated steam) worked at the high-pressure turbine 30 flow into the heating section (casing flange) 700; a pipe 300 (condensing pipe of the steam for heating the casing flange heating portion) to make the steam worked at the heating section 700 flow into the first condenser 80; and a pipe 400 (in-flow pipe of the steam for heating the second casing flange heating portion) which is branched from the pipe 500 and makes the steam worked at the intermediate-pressure turbine 40 flow into the heating section (casing flange) 700.

In short, the steam turbine power generation facility according to the present embodiment is provided with the pipe 200 to make the steam worked at the high-pressure turbine 30 flow into the heating section (casing flange) 700, in which the pipe 200 corresponds to a pipe branched from the pipe 900 to make the steam worked at the high-pressure turbine 30 flow into the intermediate-pressure turbine 40.

Further, the steam turbine power generation facility according to the present embodiment is provided with the pipe 400 to make the steam worked at the intermediate-pressure turbine 40 flow into the heating section (casing flange) 700, in which the pipe 400 corresponds to a pipe branched from the pipe 500 to make the steam worked at the intermediate-pressure turbine 40 flow into the first low-pressure turbine 60 and/or the second low-pressure turbine 70.

Moreover, in order to suppress the temperature of the intermediate-pressure turbine 40 from rising, the steam turbine power generation facility according to the present embodiment is provided with a pipe 600 (first condenser in-flow pipe) to make the steam worked at the intermediate-pressure turbine 40 flow into the first condenser 80 from the rear stage side from the intermediate-pressure turbine 40 by detouring the first low-pressure turbine 60.

The steam flowing through the pipe 200 (in-flow pipe of the steam for heating the casing flange heating portion) is steam (the steam for heating the casing flange heating portion) intended for heating the heating section 700 (for heating the casing flange) and flows in from the heating section 700 on the rear stage side of the intermediate-pressure turbine 40 and flows out from the heating section 700 on the frontal stage side of the high-pressure turbine 30.

In short, the pipe 200 to make the steam worked at the high-pressure turbine 30 flow into the heating section (casing flange) 700 is connected to the heating section (casing flange) on the rear stage side of the intermediate-pressure turbine 40.

Likewise, the steam flowing through the pipe 400 (in-flow pipe of the steam for heating the second casing flange heating portion) is steam (the steam for heating the casing flange heating portion) intended for heating the heating section 700 (for heating the casing flange) and flows in from the heating section 700 on the rear stage side of the intermediate-pressure turbine 40 and flows out from the heating section 700 on the frontal stage side of the high-pressure turbine 30.

In short, the pipe 400 to make the steam worked at the intermediate-pressure turbine 40 flow into the heating section (casing flange) 700 is connected to the heating section (casing flange) on the rear stage side of the intermediate-pressure turbine 40.

As such, according to the present embodiment, the provision of the pipes 200 and 400 or the presence of the steam flowing through the pipes 200 and 400 allows the thermal elongation difference between the revolving body and the stationary body of the high-pressure turbine 30 and the thermal elongation difference between such bodies of the intermediate-pressure turbine 40 to be overcome, thereby, leading to shortening the start-up time of the steam turbine power generation facility. Then, by utilizing the steam generated by the steam turbine power generation facility or by doing without any other supply source to feed (generate) the steam to overcome such thermal elongation difference in terms of the steam turbine power generation facility, it is unnecessary to enhance energy with which to feed such steam, thus successfully suppressing the efficiency of such facility from deterioration.

Further, the steam turbine power generation facility according to the present embodiment is provided: on the pipe 800, with valves M (main steam stop valve (MSV) 1 and main steam amount control valves (MCV) 2) to adjust the amount of the steam flowing into the high-pressure turbine 30; valves A (first valves: intermediate-pressure turbine in-flow steam stop valve (ASV) 3 and intermediate-pressure turbine in-flow steam amount control valve (ACV) 4, which are disposed on a pipe directed to the intermediate-pressure turbine 40 after the branching of the pipe 900) to adjust the amount of the steam flowing into the intermediate-pressure turbine 40 after the branching of the pipe 900; valves E (third valves: low-pressure turbine in-flow steam stop valve (ESV) 10 and low-pressure turbine in-flow steam amount control valve (ECV) 11, which are disposed on a pipe directed to the first low-pressure turbine 60 after the branching of the pipe 500) to adjust the amount of the steam flowing into the first low-pressure turbine 60 after the branching of the pipe 500; and valves F (second low-pressure turbine in-flow steam (crossover) stop valve (FSV) 12 and second low-pressure turbine in-flow steam amount (crossover) control valve (FCV) 13) to adjust the amount of the steam flowing into the second low-pressure turbine 70.

To note, the valves F are intended for adjusting the amount of the steam flowing into the second low-pressure turbine 70 and for stopping the distribution of the steam between the first low-pressure turbine 60 and the second low-pressure turbine 70 especially in a case where the steam flowing into the first low-pressure turbine 60 is smaller in amount, thereby, successfully preventing the state where the steam flowing into the first low-pressure turbine 60 is smaller in amount.

Further, the steam turbine power generation facility according to the present embodiment is provided: on the pipe 200, with valves B (second valves: first casing flange in-flow steam stop valve (BSV) 5 and first casing flange in-flow steam amount control valve (BCV) 6, which are disposed on the pipe 200 directed to the heating section 700 after the branching of the pipe 900) to adjust the amount of the steam flowing into the heating section (the steam for heating the casing flange heating portion); on the pipe 400, with valves C (fourth valves: second casing flange in-flow steam stop valve (CSV) 7 and second casing flange in-flow steam amount control valve (CCV) 8, which are disposed on the pipe 400 directed to the heating section 700 after the branching of the pipe 500) to adjust the amount of the steam flowing into the heating section 700; and on the pipe 600, with a valve D (steam stop valve (DSV) 9) to switch on and off the steam flowing into the first condenser 80.

Summing up, the first valves (valves A) are disposed on the pipe 900 (after branched) to make the steam worked at the high-pressure turbine 30 flow into the intermediate-pressure turbine 40; the second valves (valves B) are disposed on the pipe 200 which is branched from the pipe 900 to make the steam worked at the high-pressure turbine 30 flow into the intermediate-pressure turbine 40 and makes the steam worked at the high-pressure turbine 30 flow into the heating section 700; the third valves (valves E) are disposed on the pipe 500 (after branched) to make the steam worked at the intermediate-pressure turbine 40 flow into the first low-pressure turbine 60 and/or the second low-pressure turbine 70; and the fourth valves (valves C) are disposed on the pipe 400 which is branched from the pipe 500 to make the steam worked at the intermediate-pressure turbine 40 flow into the first low-pressure turbine 60 and/or the second low-pressure turbine 70 and makes the steam worked at the intermediate-pressure turbine 40 flow into the heating section 700.

The operation method of the steam turbine power generation facility according to the present embodiment is as follows, in which the method of manipulating the opening/closing of the valves respectively is disclosed.

Under the operation over the low load range (the first range), it is prescribed that the valves A, the valves C, and the valves E are in closed condition while the valves B, the valve D, the valves F, and the valves M are in opened condition.

Steam flows into the high-pressure turbine 30 from the boiler 20 (in which the valves M are opened), and the generator 50 is driven with the driving of the high-pressure turbine 30.

The steam worked at the high-pressure turbine 30 is reheated by the boiler 20, and the reheated steam flows through the pipe 200 (in which the valves A are closed while the valves B are opened) so as to flow into the heating section 700.

Then, the steam flowing into the heating section is utilized for heating the casing flange heating portion of the heating section 700 at the casing flanges of the high-pressure turbine 30 and the intermediate-pressure turbine 40. Thereafter, the steam which has been used for heating the casing flanges and whose temperature has lowered flows through the pipe 300 so as to flow into the first condenser 80 and be condensed into water.

Under the operation over the low to middle load range (the second range higher in load than the first range), it is prescribed that the valves M are in opened condition; the valves A and the valves C transit from the closed condition to the opened condition; the valves B and the valve D transit from the opened condition to the closed condition; and the valves E and the valves F are in closed condition.

Steam flows into the high-pressure turbine 30 from the boiler 20 (in which the valves M are opened); the steam worked at the high-pressure turbine 30 is reheated by the boiler 20 so as to flow through the pipe 900 (in which the valves A are opened while the valves B are closed) and flow into the intermediate-pressure turbine 40; and the generator 50 is driven with the driving of the high-pressure turbine 30 and the intermediate-pressure turbine 40.

The steam worked at the intermediate-pressure turbine 40 flows through the pipe 400 (in which the valves C are opened while the valves E are closed) so as to flow into the heating section 700.

Then, the steam flowing into the heating section is utilized for heating the casing flange heating portions of the heating sections 700 at the casing flanges of the high-pressure turbine 30 and the intermediate-pressure turbine 40. Thereafter, the steam which has been used for heating the casing flanges of the heating sections 700 and whose temperature has lowered flows through the pipe 300 so as to flow into the first condenser 80 and be condensed into water.

Under the operation over the middle load range (the third range higher in load than the second range), it is prescribed that the valves A and the valves M are in opened condition; the valves C transit from the opened condition to the closed condition; the valves E transit from the closed condition to the opened condition; and the valves B, the valve D, and the valves F are in closed condition.

Steam flows into the high-pressure turbine 30 from the boiler 20 (in which the valves M are opened); the steam worked at the high-pressure turbine 30 is reheated by the boiler 20; the reheated steam flows through the pipe 900 (in which the valves A are opened while the valves B are closed) so as to flow into the intermediate-pressure turbine 40; the steam worked at the intermediate-pressure turbine 40 flows through the pipe 500 (in which the valves C are closed; the valves E are opened; and the valves F are closed) so as to flow into the first low-pressure turbine 60; the generator 50 is driven with the driving of the high-pressure turbine 30, the intermediate-pressure turbine 40, and the first low-pressure turbine 60; and the steam worked at the first low-pressure turbine 60 flows into the first condenser 80 so as to be condensed into water.

To note, under the operation over such middle load range, the steam for heating the casing flange heating portions does not flow to the heating sections 700 at the casing flanges of the high-pressure turbine 30 and the intermediate-pressure turbine 40.

Under the operation over the high load range (the fourth range higher in load than the third range), it is prescribed that the valves A, the valves E and the valves M are in opened condition: the valves F transit from the closed condition to the opened condition; and the valves B, the valves C, and the valve D are in closed condition.

Steam flows into the high-pressure turbine 30 from the boiler 20 (in which the valves M are opened); the steam worked at the high-pressure turbine 30 is reheated by the boiler 20 so as to flow through the pipe 900 (in which the valves A are opened while the valves B are closed) so as to flow into the intermediate-pressure turbine 40; the steam worked at the intermediate-pressure turbine 40 flows through the pipe 500 (in which the valves C are closed; the valves E are opened; and the valves F are opened) so as to flow into the first low-pressure turbine 60 and the second low-pressure turbine 70; the generator 50 is driven with the driving of the high-pressure turbine 30, the intermediate-pressure turbine 40, the first low-pressure turbine 60, and the second low-pressure turbine 70; and the steam worked at the first low-pressure turbine 60 flows into the first condenser 80 so as to be condensed into water while the steam worked at the second low-pressure turbine 70 flows into the second condenser 90 so as to be condensed into water.

Hereupon, for reference, the coupling condition between the first low-pressure turbine 60 and the second low-pressure turbine 70 is being switched on with the clutch 100 disposed between the first low-pressure turbine 60 and the second low-pressure turbine 70.

To note, also under the operation over such high load range, the steam for heating the casing flange heating portions does not flow to the heating sections 700 at the casing flanges of the high-pressure turbine 30 and the intermediate-pressure turbine 40.

It should be noted that the pipe 500 corresponds to a crossover (XO) pipe to make the steam worked at the intermediate-pressure turbine 40 flow into the frontal stage side of the first low-pressure turbine 60 and/or into the frontal stage side of the second low-pressure turbine 70 according to the present embodiment.

In this way, according to the present embodiment, it is possible to provide a steam turbine power generation facility and an operation method of such power generation facility not only overcoming the thermal elongation difference (at the heating section 700) between the revolving body and the stationary body of the turbine so as to shorten the start-up time of such facility but also suppressing the efficiency of such facility from deterioration.

Fourth Embodiment

Figure 4:
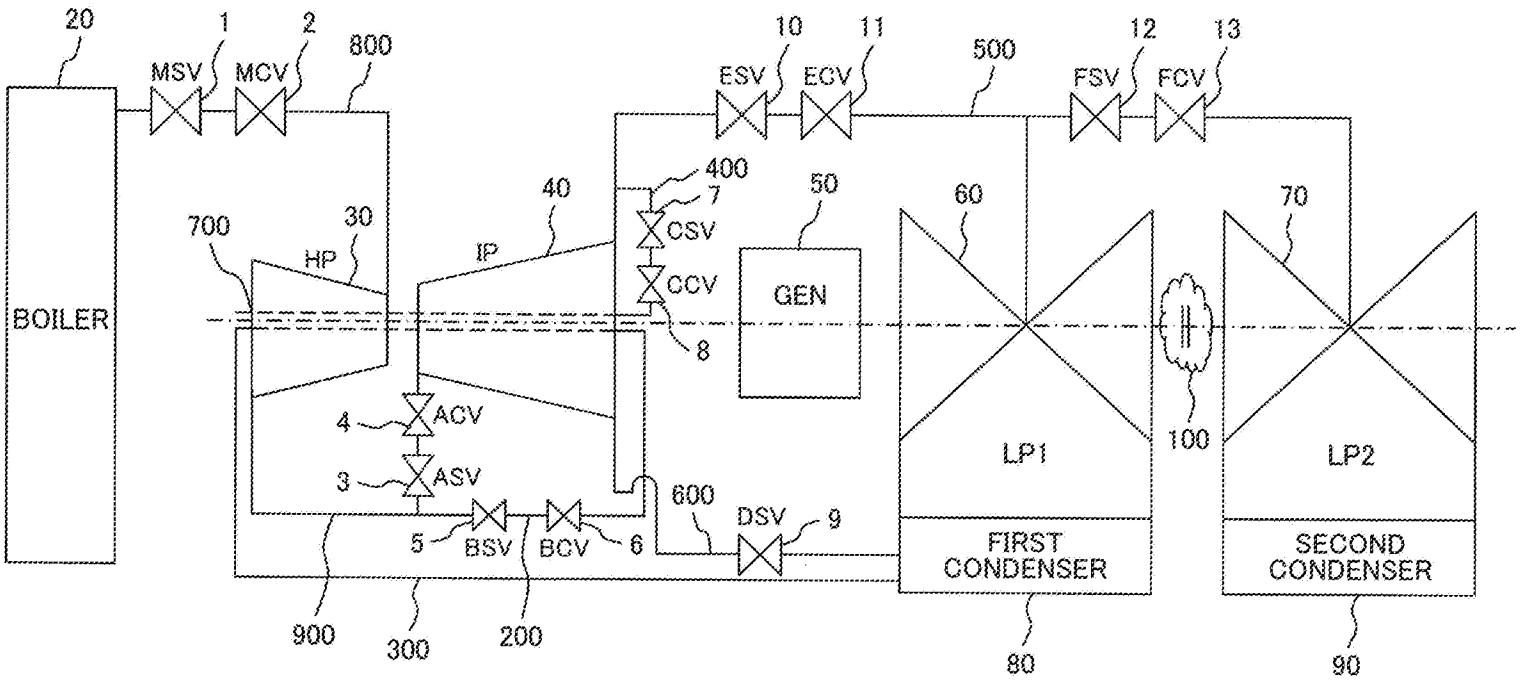
FIG. 4 is a schematic view illustrating the structure of the steam turbine power generation facility according to a fourth embodiment.

FIG. 4 is a schematic view illustrating the structure of the steam turbine power generation facility according to a fourth embodiment.

The steam turbine power generation facility according to the present embodiment includes: a boiler 20 to generate steam; a high-pressure turbine (HP) 30 into which the steam generated by the boiler 20 flows; an intermediate-pressure turbine (IP) 40 into which the steam worked at the high-pressure turbine 30 flows; a first low-pressure turbine (LP1) 60 into which the steam worked at the intermediate-pressure turbine 40 flows; a second low-pressure turbine (LP2) 70 into which the steam worked at the intermediate-pressure turbine 40 flows; a generator (GEN) 50 which is driven with the driving of the high-pressure turbine 30, the intermediate-pressure turbine 40, the first low-pressure turbine 60, and/or the second low-pressure turbine 70; a first condenser 80 to condense the steam worked at the first low-pressure turbine 60 into water; and a second condenser 90 to condense the steam worked at the second low-pressure turbine 70 into water.

The present embodiment differs from the third embodiment in that the steam worked at the high-pressure turbine 30 is not reheated by the boiler 20 but directly flowed into the intermediate-pressure turbine 40. In other words, the pipe 900 interconnects the high-pressure turbine 30 and the intermediate-pressure turbine 40.

To note, the other pipes are the same as those of the third embodiment. Further, the places where the valves are disposed are the same as those according to the third embodiment.

In addition, the operation method of the steam turbine power generation facility according to the present embodiment is the same as that according to the third embodiment.

As such, the steam turbine power generation facility and operation method of such power generation facility according to the present embodiment also brings the same advantageous effects as those brought by the counterpart facility and the counterpart operation method of such facility according to the third embodiment.

As described, according to the above embodiments, the flange sections (heating sections) of the turbine casing are heated (the casing flanges being heated) with in use the steam (for heating the casing flange heating portions). Then, by using the steam flowed out from the high-pressure turbine or the intermediate-pressure turbine for such steam, it is possible not only to shorten the start-up time of the steam turbine power generation facility (over the low load range and the low to middle load range) but also to suppress the efficiency of such facility from deterioration.

Further, according to the embodiments above, the efficient combination of the steam turbines is feasible according to the amount of the steam (according to the load ranges) and the steam higher in temperature (excessive steam) which is worked at the high-pressure turbine or the intermediate-pressure turbine can be effectively used for heating the casing flange heating portions in the low load range and the middle load range, thereby, successfully leading to shortening the start-up time of the steam turbine power generation facility and suppressing the efficiency of such facility from deterioration.

In other words, the countermeasures against the shaft vibrations and the contact between the revolving body and the stationary body owing to the thermal elongation difference between such bodies in the start-up process (over the low load range and low to middle load range) of the steam turbines cause the delay of the start-up time of the steam turbines, under which circumstances or in order to shorten which start-up time, it has been important to overcome the thermal elongation difference between such bodies as early as possible. According to the embodiments above, by heating the stationary body (especially, the casing flanges which occupy relatively higher volume within the casing) which is slower in the temperature rise changing over time than the revolving body in the start-up process of the steam turbines, it is possible not only to overcome the thermal elongation difference between the revolving body and the stationary body but also to suppress the start-up time of the steam turbines from delaying.

In addition, not by feeding from the exterior the steam with which to overcome the thermal elongation difference between the revolving body and the stationary body but by feeding such steam from the one closed loop steam turbine power generation facility, it is possible to keep the efficiency of such facility intact even while the casing flanges are heated.

Furthermore, according to the embodiments above, during the low output operation (in the start-up process of the steam turbines), since no steam is flowed into the low-pressure turbine (the first low-pressure turbine 60 and/or the second low-pressure turbine 70) whose vanes are larger in length, such low-pressure turbine is unsusceptible to the in-flow of the steam (according to its flow speed and flow rate). In short, there is no case where the vanes are damaged e.g. due to the steam flow detaching from the surfaces of the vanes of the low-pressure turbine or there is no case where the performance of the low-pressure turbine deteriorates.

According to the embodiments above, for the purpose of stably feeding electric power, the manipulation of the valves is accommodated to such a wide range as covering from low load to high load, in each of which range the performance of each steam turbine can be kept intact. Then, by shortening the start-up time and suppressing the efficiency of the power generation facility from deterioration, it is possible to keep the performance of each steam turbine intact over such a wide range as covering from the low load range to the high load range.

It should be noted that the present invention is not limited to the above embodiments, but can be modified into various manners. For instances, the above embodiments are presented herein in detail to facilitate the persons skilled in the art to understand the present invention, so that the present invention is not necessarily limited to those with all the features presented herein. Further, some of the features according to a certain embodiment can be replaced with those of the other embodiments in the meantime the features of the other embodiments can be added to those of a certain embodiment.

LIST OF REFERENCE SIGNS

1: main steam stop valve
2: main steam amount control valve
3: intermediate-pressure turbine in-flow steam stop valve
4: intermediate-pressure turbine in-flow steam amount control valve
5: casing flange in-flow steam stop valve
6: casing flange in-flow steam amount control valve

7: casing flange in-flow steam stop valve
8: casing flange in-flow steam amount control valve
9: intermediate-pressure turbine out-flow steam stop valve
10: low-pressure turbine in-flow steam stop valve
11: low-pressure turbine in-flow steam amount control valve
12: second low-pressure turbine in-flow steam stop valve
13: second low-pressure turbine in-flow steam amount control valve
20: boiler
30: high-pressure turbine
40: intermediate-pressure turbine
50: generator
60: first low-pressure turbine
70: second low-pressure turbine
80: first condenser
90: second condenser
100: clutch
700: heating section

What is claimed is:

1. A steam turbine power generation facility comprising:
a boiler to generate steam;
a high-pressure turbine into which the steam generated by the boiler flows;
an intermediate-pressure turbine into which steam worked at the high-pressure turbine flows; and
a low-pressure turbine into which steam worked at the intermediate-pressure turbine flows, wherein
the high-pressure turbine and the intermediate-pressure turbine are respectively provided with a heating section which is formed by extending through the high-pressure turbine and the intermediate-pressure turbine,
the steam turbine power generation facility further comprising a first pipe to make the steam worked at the high-pressure turbine flow into the heating section, and
the first pipe to make the steam worked at the high-pressure turbine flow into the heating section is connected to the heating section on a rear stage side of the intermediate-pressure turbine.

2. The steam turbine power generation facility according to claim 1, further comprising a second pipe to make the steam worked at the high-pressure turbine flow into the intermediate-pressure turbine,
wherein the first pipe to make the steam worked at the high-pressure turbine flow into the heating section is branched from the second pipe to make the steam worked at the high-pressure turbine flow into the intermediate-pressure turbine.

3. The steam turbine power generation facility according to claim 2, wherein the first pipe and the second pipe are respectively provided with a valve to adjust an amount of steam.

4. The steam turbine power generation facility according to claim 1, further comprising a second pipe to make the steam worked at the intermediate-pressure turbine flow into the heating section.

5. The steam turbine power generation facility according to claim 4, wherein the second pipe to make the steam worked at the intermediate-pressure turbine flow into the heating section is connected to the heating section on the rear stage side of the intermediate-pressure turbine.

6. The steam turbine power generation facility according to claim 5, further comprising a third pipe to make the steam worked at the intermediate-pressure turbine flow into the low-pressure turbine,
wherein the second pipe to make the steam worked at the intermediate-pressure turbine flow into the heating section is branched from the third pipe to make the steam worked at the intermediate-pressure turbine flow into the low-pressure turbine.

7. The steam turbine power generation facility according to claim 6, wherein the second pipe and the third pipe are respectively provided with a valve to adjust an amount of steam.

8. An operation method of a steam turbine power generation facility to manipulate opening/closing of: first valves which are disposed on a first pipe to make steam worked at a high-pressure turbine flow into an intermediate-pressure turbine; second valves which are disposed on a second pipe which is branched from the first pipe to make the steam worked at the high-pressure turbine flow into the intermediate-pressure turbine and makes the steam worked at the high-pressure turbine flow into a heating section; third valves which are disposed on a third pipe to make steam worked at the intermediate-pressure turbine flow into a low-pressure turbine; and fourth valves which are disposed on a fourth pipe which is branched from the pipe to make the steam worked at the intermediate-pressure turbine flow into the low-pressure turbine and makes the steam worked at the intermediate-pressure turbine flow into the heating section,
wherein the first valves, the third valves, and the fourth valves are in closed condition while the second valves are in opened condition under an operation over a first load range.

9. The operation method of the steam turbine power generation facility according to claim 8, wherein the first valves and the fourth valves are in opened condition while the second valves and the third valves are in closed condition under an operation over a second load range whose load is larger than the first load range.

10. The operation method of the steam turbine power generation facility according to claim 9, wherein the first valves and the third valves are in opened condition while the second valves and the fourth valves are in closed condition under an operation over a third load range whose load is larger than the second load range.

* * * * *